United States Patent [19]

Zepf

[11] 4,136,469

[45] Jan. 30, 1979

[54] SHOVEL TOOTH

[76] Inventor: Hans-Rudolf Zepf, Hirsackerstrasse 30, Horgen, Switzerland

[21] Appl. No.: 805,473

[22] Filed: Jun. 10, 1977

Related U.S. Application Data

[63] Continuation of Ser. No. 656,793, Feb. 10, 1976, abandoned.

[30] Foreign Application Priority Data

Feb. 21, 1975 [CH] Switzerland ..... 2195/75

[51] Int. Cl.[2] ..... E02F 9/28

[52] U.S. Cl. ..... 37/141 T; 37/142 R

[58] Field of Search ..... 37/141 R, 141 T, 142 R, 37/142 A; 172/703, 713; 299/91-93; D39/1 R, 1 A, 1 B

[56] References Cited

U.S. PATENT DOCUMENTS

| | | | |
|---|---|---|---|
| 2,227,674 | 1/1941 | Ratkowski | 37/142 R |
| 3,368,293 | 2/1968 | Judkins et al. | 37/142 R |
| 3,748,763 | 7/1973 | Zepf | 37/141 R |
| 3,841,007 | 10/1974 | Howarth et al. | 37/141 R |
| 3,974,579 | 8/1976 | Black et al. | 37/141 T |

*Primary Examiner*—Ronald E. Suter

*Attorney, Agent, or Firm*—Roylance, Abrams, Berdo & Farley

[57] ABSTRACT

A shovel tooth for an earth-moving shovel includes a tooth holder having a hollow shell-like portion fixedly attached to the inner surface of a shovel blade, the shell having an end web extending along the edge of the blade and a projecting portion attached to the end web and extending beyond the blade edge. A tooth cap has a hollow interior dimensioned to receive and frictionally engage the projecting portion, the projecting portion and the tooth cap having aligned opening to receive a fastener such as a bolt. The projecting portion and the interior cavity of the tooth cap are symmetrical about a longitudinal axis of the projecting portion so that the cap can be removed and replaced in either of two positions separated by 180° of cap rotation. The shell and the tooth cap are provided with reinforcing webs which are substantially aligned with each other in the assembled condition. The projecting portion and the cap cavity taper from the end web to the tip of the projecting portion.

7 Claims, 3 Drawing Figures

SHOVEL TOOTH

This is a continuation of application Ser. No. 656,793, filed Feb. 10, 1976, now abandoned.

This invention relates to a shovel tooth for a shovel on a construction machine, particularly of the earth-moving type.

BACKGROUND OF THE INVENTION

It is well recognized that teeth on a construction machine shovel are subject to wear and that they must be periodically replaced. Numerous forms of shovel teeth for this purpose are known. In such prior art, teeth are generally made with a detachable cap portion so that only the cap needs to be replaced. However, because of the non-uniform wear of tooth caps, considerable material waste occurs.

BRIEF SUMMARY OF THE INVENTION

An object of the present invention is to provide a shovel tooth of the general type described wherein a completely satisfactory and firm attachment of the structure to the shovel blade is insured and wherein the tooth cap can be removed and rotated so that the side worn by use is replaced by the side of the tooth cap which has not been exposed to significant wear.

Briefly described, the invention includes a shovel tooth for a construction machine of the type having a shovel blade with an inner surface and a front edge comprising a tooth holder attached to the inner surface of the blade, the tooth holder having a hollow, generally U-shaped shell having edges rigidly attached to the inner surface of the blade, and a projecting portion connected to the shell and extending beyond the front edge of the shovel blade, the projecting portion having a symmetrical profile, and a tooth cap detachably mounted on the projecting portion, the tooth cap having an interior cavity shaped to receive and substantially mate with the projecting portion, the interior cavity being symmetrical to receive said portion in either of two positions separated by 180° of cap rotation.

In order that the manner in which the foregoing and other objects are attained in accordance with the invention can be understood in detail, a particularly advantageous embodiment of the invention will be described with reference to the accompanying drawings, which form a part of this specification, and wherein.

Figure 1:
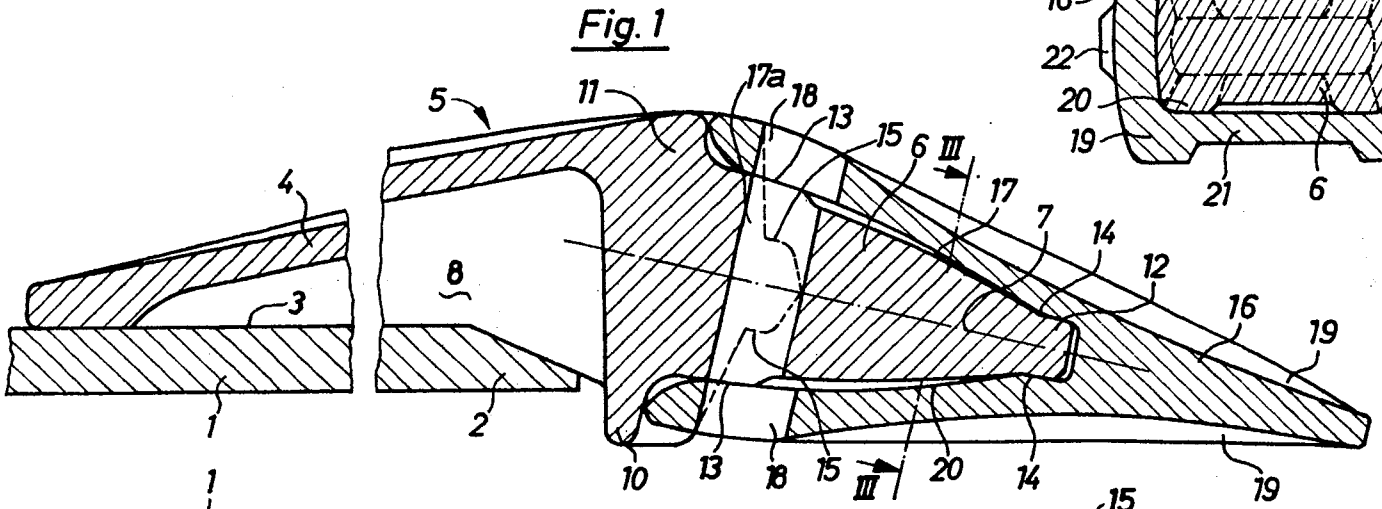
FIG. 1 is a side elevation in section of a shovel tooth in accordance with the invention.

The invention will be described in connection with a typical shovel blade of the type used for a dredging shovel. As seen in the figures, the shovel blade 1 has at its front edge a chamfered portion 2 and an inner surface 3. The rear portion 4 of a shovel tooth holder indicated generally at 5 is fixedly attached to the inner surface 3 of blade 1 as, for example, by welding. Tooth holder 5 has a front or projecting portion 6 which projects beyond the front edge of blade 1, portion 6 being generally wedge shaped in vertical section, as seen in FIG. 1. Also, as will be seen in FIG. 1, the front portion 6 is symmetrical with respect to a central axis 7, the axis being rearwardly inclined with respect to the shovel blade so that the axis lies in a plane which forms an acute angle with the inner surface of the blade.

For strength purposes, it is important that rear portion 4 of the tooth holder 5 is constructed as a U-shaped half shell having side walls or legs 8 and 9 which are connected by a bight and which extend substantially longitudinally with respect to tooth holder 5. Constructing rear portion 4 of holder 5 as a half shell gives the shovel tooth the necessary large yield strength and also permits solid welding of the legs 8 and 9 to the inner surface 3 of blade 1. A web 10 extends across the end of rear shell portion 4, this web extending over the edge of blade 1 and substantially closing the shell portion and providing a point of definition between the two portions of the tooth holder.

As shown in FIG. 1, the bight, the legs 8, 9, the rearward end and the web 10 of the shell define a recess in the shell which opens toward the blade inner surface when attached thereto. The cross-sectional area of the recess taken in planes parallel to the inner surface of the blade and bounded by the legs 8, 9, the rearward end and the web 10 of the shell constantly increases from the bight to the continuous edge formed by the termination of the legs and rearward end of the shell. By forming the recess in this manner, the entire surface area of the recess is exposed from the underside of the shell since no other portion of the shovel tooth extends rearwardly from the lower edge portion of the web and across the recess.

Figure 2:
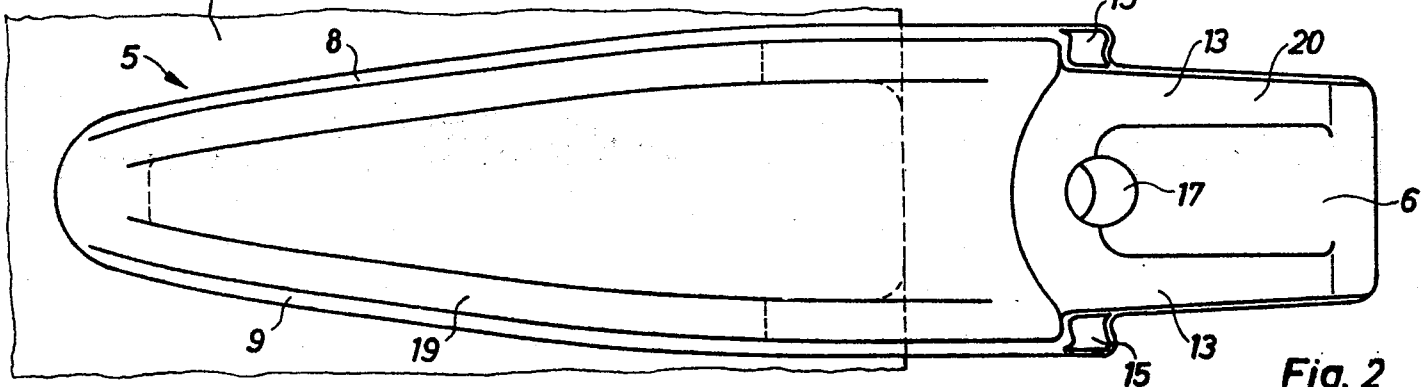
FIG. 2 is a plan view of the tooth assembly of FIG. 1.

The front portion 6 of tooth holder 5 has bearing portions or surfaces 13 and 14 arranged symmetrically with respect to axis 7, bearing portions 13 being at the root area of portion 6 and surfaces 14 being at the tip of portion 6, the bearing portions having a slight taper. As can be seen in FIG. 2, which shows the tooth holder without the cap, further bearing portions 15 are provided laterally of portion 6 on root 11 which is integrally formed with web 10.

Bearing portions 13, 14 and 15 serve to fixedly engage a tooth cap 16 having an inner cavity 17 which is dimensioned to frictionally engage the corresponding counter surfaces of bearing portions 13, 14 and 15. Cap 16 is secured to front portion 6 by means of a bolt, such as a spring cotter, the bolt not being shown. The bolt passes through a bore **17*a* in the vicinity of root 11 of front portion 6 and through bores 18 in cap 16. As a result of the multiple engagement of the bearing surfaces of cap 16, it is possible to obtain a connection between the tooth cap and front portion 6 of holder 5 which is free of play when the bolt is applied therethrough. It is important that the bearing portions 13, 14 and 15** are constructed with a slight taper which makes high frictional engagement of the various mating surfaces possible.

As a result of the symmetrical disposition of bearing portions 13, 14 and 15, it is possible to remove the cap and rotate it 180° and restore it onto the tooth holder, even though the outer surface of the tooth may not be symmetrical, thereby exposing the unworn outer surfaces thereof for further use.

Figure 3:
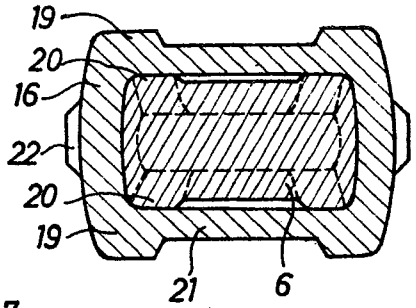
FIG. 3 is a section along lines III—III of FIG. 1.

It will be observed that web-like reinforcements 19 are provided on the outer surface of rear portion 4 and on the two outer surfaces of tooth cap 16. Reinforcements 19 of cap 16 are supported by web-like reinforcements 20 of front portion 6 which are approximately aligned with reinforcements 19 as shown in FIG. 3. This results in a direct transmission of force from tooth cap 16 into front portion 6 so that portions 21 between reinforcements 19 can be dimensioned smaller. Similar web-like reinforcements 22 can also be provided along the sides of cap 16.

While one advantageous embodiment has been chosen to illustrate the invention, it will be understood by those skilled in the art that various changes and modifications can be made therein without departing from the scope of the invention as defined in the appended claims.

What is claimed is:

1. A shovel tooth for use in combination with a construction machine of the type having a shovel blade having an inner surface and a front edge comprising:

a unitary tooth holder including a rear portion attachable to the inner surface of the blade and formed as a half shell having a generally U-shaped cross section, said half shell defining a recess opening toward the blade inner surface when attached thereto and having closed forward and rearward ends, said U-shaped cross section having a bight and two legs extending from each side of said bight, said legs and said rearward end terminating in a continuous edge, said continuous edge being rigidly attachable to only the inner surface of the blade so that said half shell and the inner surface of the blade define a cavity therebetween when attached, the cross-sectional area of said recess taken in planes parallel to the inner surface of the blade and bounded by said legs and ends constantly increasing from said bight to said continuous edge;

a transverse web extending across the forward end of said half shell with one side thereof integrally attached thereto and forming said closed forward end of said recess, a lower edge portion of said web extending partly along and covering a portion of the front edge of the blade when said half shell and the inner surface of the blade are attached;

the entire surface area of said recess being exposed from the underside of said half shell with no other portion of the shovel tooth extending rearwardly from said lower edge portion of said web;

a forward projecting portion integrally connected to the opposite side of said web from said half shell, said forward projecting portion extending away from the front edge when said half whell and the inner surface of the blade are attached; and a tooth cap detachably mounted on said forward projecting portion, said cap having an interior cavity shaped to receive and substantially mate with said forward projecting portion.

2. A shovel tooth according to claim 1, wherein said continuous edge is rigidly attachable to the inner surface by means of welding.

3. A shovel tooth according to claim 1, wherein said forward projecting portion has a symmetrical profile and said interior cavity of said cap is symmetrical to receive said forward projecting portion in either of two positions separated by 180° of cap rotation.

4. A shovel tooth according to claim 1, further including a shovel blade of a construction machine having an inner surface and a front edge, said tooth holder being rigidly attached to said inner surface.

5. A shovel tooth according to claim 1, wherein only said continuous edge is attachable to said inner surface.

6. A shovel tooth according to claim 1 wherein said projecting portion has root bearing portions adjacent said shell and tip bearing portions at its distal end, said bearing portions being dimensioned to frictionally engage the interior of said cap, said bearing portions tapering inwardly from said root portions to said tip portions symmetrically with respect to a central axis of said projecting portion.

7. A tooth according to claim 1 wherein said projecting portion including reinforcing webs extending along the outer surfaces thereof generally parallel with the longitudinal axis of said tooth, and said tooth cap includes edge reinforcing webs substantially aligned with and supported by said reinforcing webs on said projecting portion.

* * * * *